US005919533A

United States Patent [19]

Smith et al.

[11] Patent Number: 5,919,533

[45] Date of Patent: Jul. 6, 1999

[54] FRAME FOR SUPPORTING THE PAD IN A PAD-TYPE HUMIDIFIER UNIT

[75] Inventors: Timothy J. Smith; Edward L. Schwarz, both of Minneapolis, Minn.

[73] Assignee: Honeywell Inc., Minneapolis, Minn.

[21] Appl. No.: 08/883,987

[22] Filed: Jun. 27, 1997

[51] Int. Cl.[6] ..... A47G 1/12; B01F 3/04

[52] U.S. Cl. ..... 428/14; 261/106; 428/122

[58] Field of Search ..... 428/14, 122; 261/106

[56] References Cited

U.S. PATENT DOCUMENTS

| | | | |
|---|---|---|---|
| 3,975,470 | 8/1976 | Engel | 261/106 |
| 4,125,576 | 11/1978 | Kozinski | 261/106 |
| 4,158,679 | 6/1979 | Yeagle | 261/106 |
| 4,443,386 | 4/1984 | Wrightson | 261/106 X |
| 5,168,832 | 12/1992 | Price | 261/106 X |
| 5,211,891 | 5/1993 | Anoszko | 261/106 |
| 5,853,625 | 12/1998 | Kensok et al. | 261/106 |

*Primary Examiner*—Henry F. Epstein
*Attorney, Agent, or Firm*—Edward L. Schwarz

[57] ABSTRACT

An in-duct humidifier has a permeable rectangular pad to be placed in a heated air stream. Water dripping onto the top of the pad is evaporated by the air stream which is passing through the pad to thereby increase its humidity. The pad is held in a frame and the frame is mounted in the humidifier's housing. The frame holds the pad by an arrangement of sloped surfaces and narrow projections to minimize the area of the frame in direct contact with the pad. By minimizing the contact area between the pad and the frame, the amount of water flowing onto the frame and evaporating from the frame is minimized, thereby reducing the rate and amount of minerals dissolved in the water which are deposited on the frame surfaces.

10 Claims, 3 Drawing Sheets

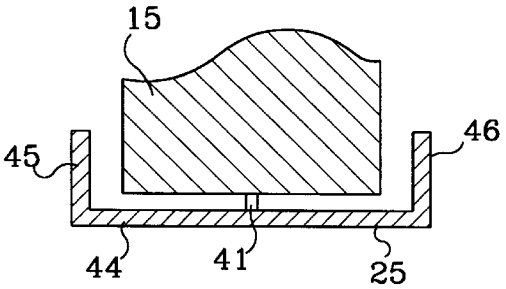
Fig. 2
Fig. 3
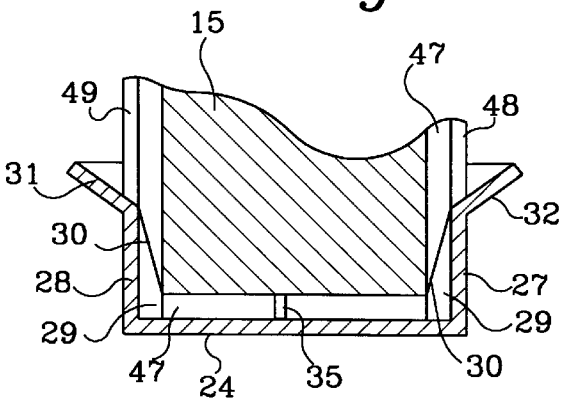
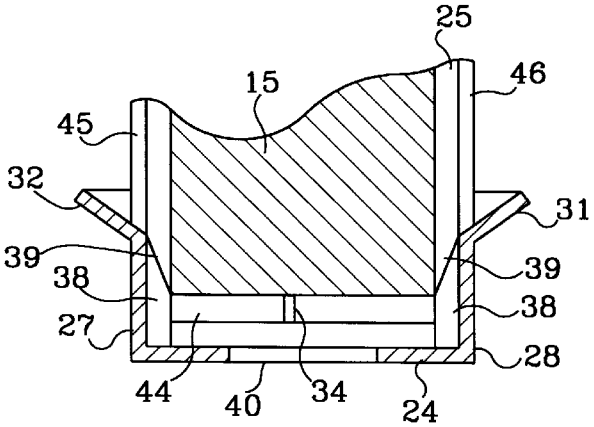
Fig. 4
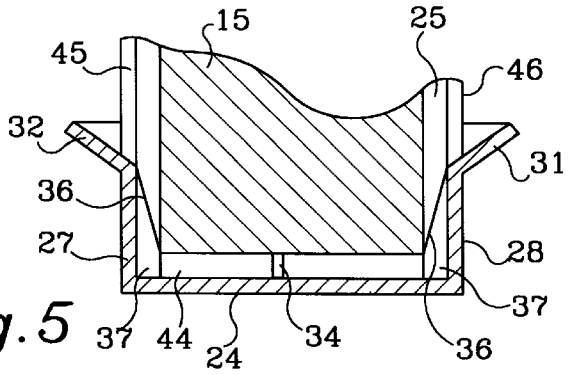
Fig. 5

FRAME FOR SUPPORTING THE PAD IN A PAD-TYPE HUMIDIFIER UNIT

BACKGROUND OF THE INVENTION

In cold climates particularly where occupied spaces must be heated, air in these spaces tends to have low relative humidity. This is uncomfortable and sometimes even unhealthy. To remedy this problem, people use humidifiers to add humidity to the air in these spaces.

Humidifiers have a variety of different designs. There are small stand-alone units intended for a single room. Larger units are designed for permanent installation as a component of a central heating system. These add moisture to the stream of heated air passing through the furnace duct to the occupied space. The latter type of humidifier will be referred to as an "in-duct" humidifier hereafter. The humidifier whose description follows is an improvement to one common type of in-duct humidifier.

There are a number of different designs for in-duct humidifiers. The kind which is involved here has an air-permeable pad, typically made from a number of similarly sized layers of thin expanded aluminum sheet stacked to a thickness of perhaps 1.5 in. (3.8 cm.). The layers of aluminum sheet are bonded to each other so as to create a pad structure having a rectangular box-like shape. Such a pad of expanded aluminum construction is rigid or semi-rigid, but relatively light and quite easily crushed. The pad is mounted in a housing which is placed in or near the furnace duct so that air warmed by the furnace can flow through the housing and the pad within it. Water is allowed to drip onto the top surface of the pad at a rate which keeps the pad moist from top to bottom. The warm air passing through the pad evaporates the water in the pad, adding humidity to the air. In some designs, the pad is first mounted in a frame which is then inserted into the humidifier housing.

The water drips onto the pad from what is called a water distribution tray, or simply a tray. The tray extends along the top surface of the pad and has a reservoir for holding a small amount of water. Water is fed to the tray from the building water supply, and flow is controlled by a solenoid valve. The tray has holes spaced along its bottom through which water flowing into the tray falls onto the top of the pad. By properly selecting the rate at which water is added to the tray, the pad can be kept moist from top to bottom. The pad, the tray, and a housing supporting them in the proper spatial relationship comprise the most important elements of an in-duct humidifier. It is important for efficient operation of the humidifier that the tray evenly distribute water across the entire width of the pad.

The minerals dissolved in the water which is fed to the tray and which wets the pad sometimes create a problem for humidifiers of many types including these pad-type humidifiers. We find that water seeping or spraying from the pad will dry on the interior of the housing and on the ductwork, eventually building up to a substantial thickness which may interfere with its operation. The use of a pad frame such as is shown in U.S. Pat. No. 5,211,891 issued to Anoszko on May 18, 1993 to isolate the pad from the housing is helpful in reducing the amount of such mineral buildup. But it is possible to limit mineral deposits even more effectively than is shown in Anoszko.

BRIEF DESCRIPTION OF THE INVENTION

An improved frame is intended for supporting a rigid humidifier pad substantially in the form of a rectilinear block. Such a frame has two side sections for vertical orientation each having top and bottom ends. A bottom section for horizontal orientation is joined to the bottom ends of the side sections so as to form with the side sections a U-shaped frame defining an inner area for receiving the humidifier pad. The bottom section has side walls extending generally upwards into the inner area from a floor so as to form a U-shaped cross section thereof. The bottom section has adjacent to the walls thereof, first and second angled surfaces facing each other, with each angled surface sloping downwardly and away from the adjacent wall thereof. The angled surfaces are intended to engage the bottom corner edges of the humidifier pad and retain the humidifier pad in spaced relationship to each of the bottom section walls.

BRIEF DESCRIPTION OF THE DRAWINGS

FIG. 2 is a cross section view of a wall section of the frame element of the pad frame assembly of FIG. 1.

FIGS. 3–5 are cross section views of various parts of a floor section of the frame element of the pad frame assembly of FIG. 1.

DESCRIPTION OF THE PREFERRED EMBODIMENTS

Figure 1:
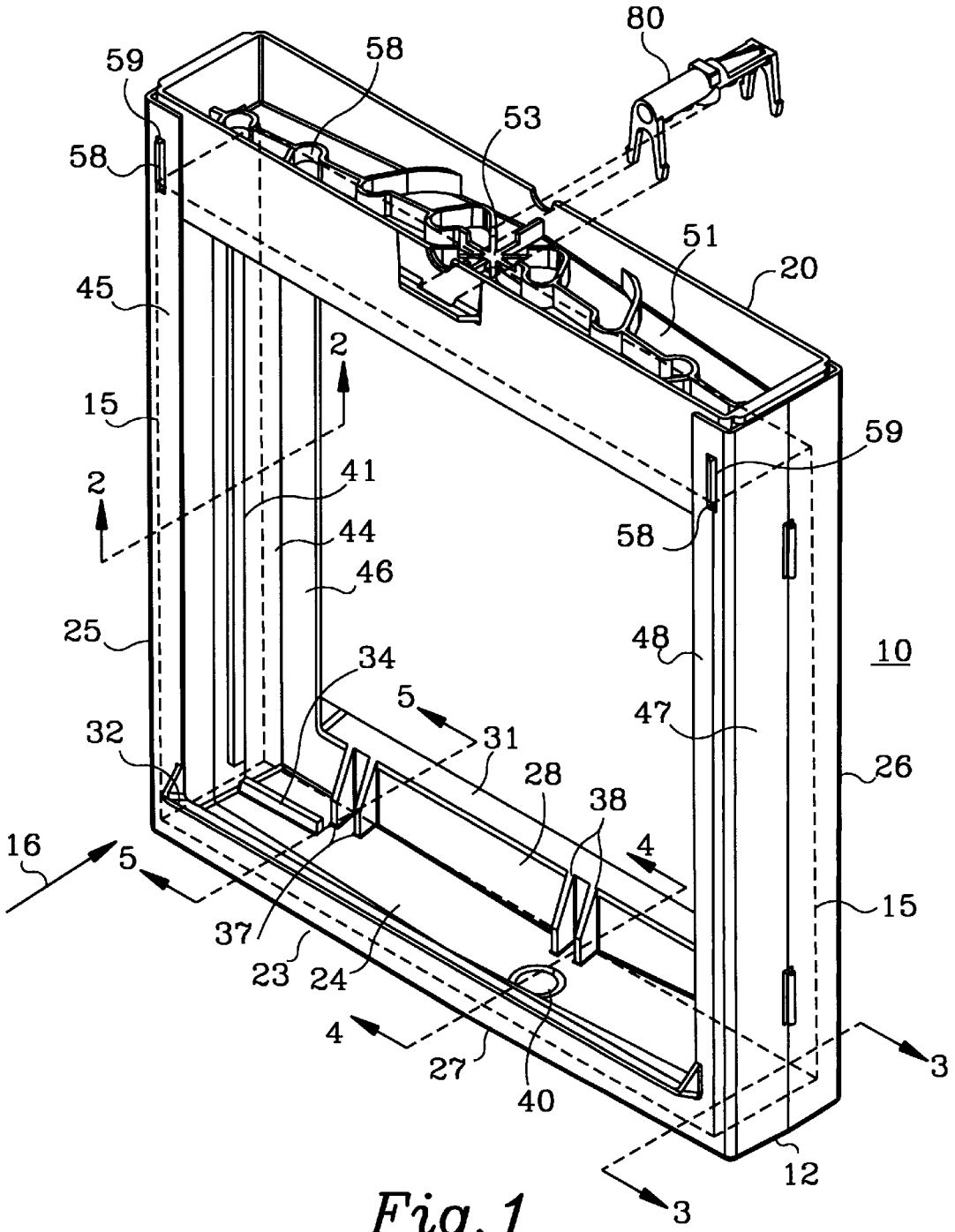
FIG. 1 is a perspective view of a pad frame assembly.

The pad frame assembly 10 shown in FIG. 1 is intended for mounting in a suitable humidifier housing (not shown) designed to support in a stream of heated air provided by a furnace, a rigid humidifier pad 15 substantially in the form of a rectilinear block. The basic design premise for the assembly 10 forming the subject of this invention is to support the pad 15 at a few points only so that the paths along which water must move to reach either the frame or the housing are relatively long and relatively small. By creating these relatively long and small paths, water in pad 15 is prevented from efficiently wetting a pad frame 12 or the housing which contains the assembly 10. By reducing the amount of water which actually reaches the frame 12 and the housing in which it is mounted, the amount of minerals which are deposited from the water as it evaporates will be reduced. Instead, the concentration of minerals in such a humidifier are temporarily retained within the pad 15 itself, and as water continues to flow onto pad 15, will be flushed out through the bottom of pad 15.

In FIG. 1, pad 15 is shown in dotted outline within frame 12. Frame 12 comprises first and second side sections 25 and 26, each having a top end and a bottom end. The bottom end of each side section 25 and 26 is unitary with a bottom section 23 having a floor 24 and side walls 27 and 28. Side sections 25 and 26 are substantially parallel to each other and at right angles to bottom section 23 so as to together form a U-shaped frame 12 which defines an inner area between side sections 25 and 26. This inner area is to be occupied by a humidifier pad 15 whose dimensions are chosen with reference to the dimensions of the frame 12 itself as will be explained. Walls 27 and 28 and floor 24 are arranged to form a substantially U-shaped cross section for bottom section 23. Floor 24 is angled downward slightly from the ends thereof adjacent to side sections 25 and 26 to a drain hole 40 centrally positioned in floor 24. In other embodiments, the bottom section 23 may instead have a cross section which is generally concave upwards with no clearly defined walls. It is only necessary that bottom section 23 be able to gather excess water flowing through pad 15 and divert it to drain hole 40.

Side sections 25 and 26 have respectively, frame walls 44 and 47 and side walls 45, 46 and 48, 49 (see FIG. 3) creating a generally U-shaped cross section. These walls first of all, cooperate to provide stiffness for side sections 25 and 26. Secondly, side walls 45, 46 and 48, 49 tend to block water which may fly off the edges of pad 15 from reaching the humidifier housing in which the pad frame assembly is mounted. Our invention does not involve any particular configuration for side sections 25 and 26, and in the appropriate design, no side walls 45,46 and 48,49 may be needed. The required side section stiffness could also be provided by other structural features.

A water distribution tray 20 is connected across the top ends of side sections 25 and 26. This tray forms the subject matter of a patent application entitled Water Distribution Tray For a Pad-Type Humidifier Unit which application has Ser. No. 08/883,986 filed June 27, 1997 and now U.S. Pat. No. 5,853,625, a common filing date with this application and Timothy Kensok and Timothy Smith as applicants. A nozzle assembly 80 is mounted above a water reception area 53 to provide a flow of water to tray 20. Water runs down the sloping segments of floor 51 and across its upper surface to a number of holes 58 in floor 51. The water falls through holes 58 to the top surface of pad 15 so as to keep the entire volume of pad 15 moist when warm air is flowing through pad 15. Tray 20 is attached to the top ends of side sections 25 and 26 by the fit of tabs 58 carried on tray 20 into slots 59 present in the top ends of side sections 25 and 26.

Pad 15 is held in a preferred position within frame 12 by an arrangement of angled surfaces, pad supports, and projections located within bottom section 23, on the underside of tray 20, and on the inner surfaces of side sections 25 and 26. These surfaces and supports hold and restrain pad 15 at a relatively few points and prevent pad 15 from contacting any flat surfaces of frame 12. By supporting pad 15 in this way, the potential for water applied to pad 15 to carry dissolved minerals to surfaces within the humidifier is substantially reduced.

Referring to FIGS. 3 and 5 as well as FIG. 1, pairs of wedge-shaped plates 29 and plates 37 are mounted adjacent to the edges of floor 24. In the embodiment shown here, plates 29 and 37 are located within the fillets formed by the intersection of walls 27 and 28 with floor 24 and adjacent respectively to side sections 26 and 25. In the preferred embodiment shown in FIG. 1, there are actually two pairs of plates 37, with one plate from each pair obscured therein by wall 27 and therefore not visible in FIG. 1. Similarly, there are two pairs of wedge-shaped plates 29 adjacent to side section 26. These are completely obscured by wall 27 and side section 26 in the view shown in FIG. 1. However, the cross section view of FIG. 3 shows one of the pairs of plates 29 occupying the fillet areas between wall 28 and floor 24 and between wall 27 and floor 24. Each of plates 29 and plates 37 carry an angled surface or ramp 30 (for plates 29) or 36 (for plates 37). Each of the angled surfaces 30 and 36 generally face the opposite bottom section wall 27 or 28. And each angled surface 30 and 36 slopes downwardly and away from the bottom section wall 27 or 28 adjacent thereto. These angled surfaces 30 and 36 are designed to engage the bottom front and back corner edges of properly dimensioned humidifier pad 15 so as to retain and align pad 15 in spaced relationship to both of the bottom section walls 27 and 28 and to side section walls 45, 46, 48, and 49. Angled surfaces 30, 36, and 39 steer the bottom edges of pad 15 away from walls 27 and 28 during pad 15 installation and may not in every design and configuration be in precise contact with the edges of pad 15 after installation is complete.

There are also pad supports 34 (FIGS. 1, 4, and 5) and 35 (FIG. 3) on which the bottom surface of pad 15 rests. Supports 34 and 35 maintain a small clearance space between pad 15 and floor 24 which allows water collecting at the bottom of pad 15 and in bottom section 23 to more rapidly drain toward drain 40 in floor 24. One can see that there is a small slope toward drain hole 40 from each end of floor 24 which causes water which flows through to the bottom of pad 15, to rapidly drain from bottom section 23.

In our preferred embodiment for frame 12 there are also two pairs of wedge-shaped third plates 38 which align pad 15 near its center. Each of the pairs of third plates 38 are located within and at roughly equal distances from the ends of, bottom section 23. Each of the third plates 38 has an angled surface 39 essentially identical to the angled surfaces 30 and 36 on plates 37 and 38. The third plates 38 are also positioned in the fillet areas formed by the intersections of walls 27 and 28 with floor 24 in the same manner that plates 29 and 37 are positioned. It is not clear that plates 38 are absolutely necessary for proper alignment of pad 15 with respect to frame 12, but are disclosed for the purposes of completeness.

Figure 6:
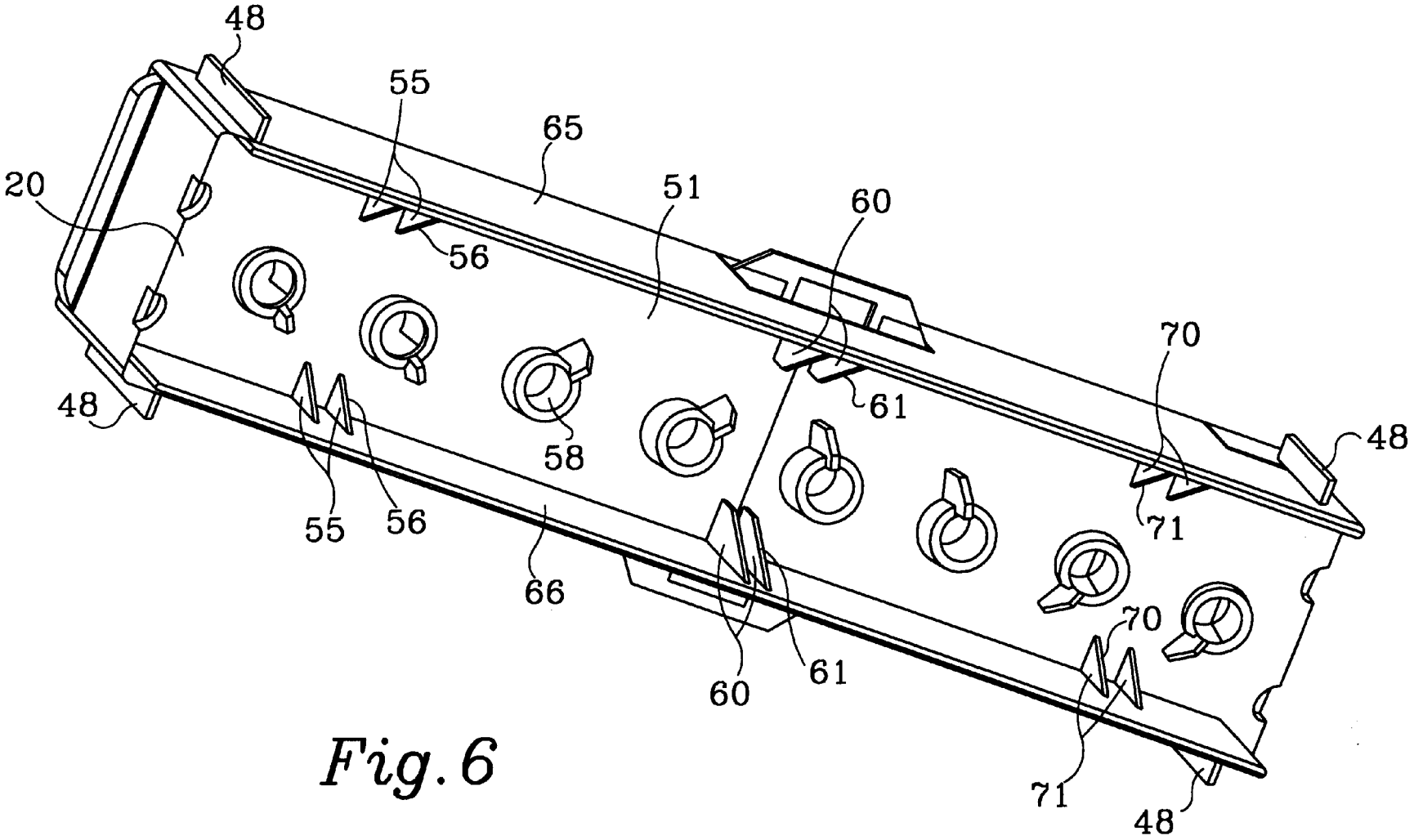
FIG. 6 is a perspective view of the bottom of a water distribution tray forming a part of the assembly of FIG. 1.

Tray 20 also provides an alignment function for pad 15. FIG. 6 shows tray 20 in a partially inverted position displaying its underside. In this view, one can easily see the holes 58 in floor 51 of tray 20 through which during humidifier use, water drains onto pad 15. Walls 65 and 66 extend lengthwise along floor 51 and downwardly therefrom, intersecting floor 51 along side edges thereof. There are in the underside of tray 20 two pairs of plates 55 shown adjacent to each other, and each plate mounted adjacent to the side edges of floor 51. Each one of the plates 55 carries an angled surface 56 which with tray 20 in its normal upright position (opposite to that shown in FIG. 6), slopes downwardly and outwardly from floor 51. Similarly, pairs of plates 60 and 70 are placed along these side edges of floor 51 and have similar angled surfaces 61 and 71 respectively. Surfaces 56, 61, and 71 are intended to engage the upper front and back corners of pad 15 to retain and align pad 15 in spaced relationship to both of the tray 20 walls 65 and 66 and walls 45, 46, 48, and 49 of side sections 25 and 26.

Side section 25 carries a spacer rib 41 on the inside surface midway between walls 45 and 46 and extending along substantially the entire longitudinal (vertical) length of side section 25. Rib 41 projects toward side section 26 and engages the adjacent side of pad 15. The cross section of side section 25 in FIG. 2 shows how rib 41 engages pad 15. Rib 41 is intended to ensure that there is a slight spacing between side section 25 and pad 15, and also prevents air from bypassing pad 15 by flowing between frame wall 44 and pad 15. Side section 26 has a similar spacer rib (not shown) extending along its entire vertical length from frame wall 47 and having a similar relationship with the side of pad 15 and similar purposes for its presence.

When a pad 15 is to be mounted in frame assembly 10, tray 20 is detached from frame 12 by elastically deflecting walls 45, 46, 48, and 49 outwardly, freeing tabs 58 and allowing tray 20 to be removed from frame 12. A pad 15 of suitable dimensions is slipped into the interior space defined by side sections 25 and 26 and bottom section 23. Reattaching tray 20 causes each of the angled surfaces 30, 36, 39, 56, 61, and 71; pad supports 34 and 35; the internal rib 41; and the rib carried by side section 26, all to engage pad 15. With all of these angled surfaces, pad supports, and ribs simultaneously engaging and supporting pad 15, pad 15 is held in frame assembly 10 with only a small amount of total area in contact with frame 12. Minimizing the area of contact seems to reduce the amount of water which flows from pad 15 to the frame and housing surfaces surrounding it. Accordingly little water on these surfaces is available to evaporate from them, reducing substantially the rate and amount of mineral buildup on them.

The following has described our invention. What we wish to claim as our invention is:

1. A frame for supporting a rigid humidifier pad substantially in the form of a rectilinear block, said frame having two side sections for vertical orientation each having top and bottom ends, and a bottom section for horizontal orientation joined to the bottom ends of the side sections so as to form a U-shaped frame defining an inner area for receiving the humidifier pad, said bottom section having a floor extending from one to the other of the side sections and including first and second side walls extending along floor edges and generally upwards into the inner area from the floor so as to form a concave cross section thereof, said bottom section having a first angled surface adjacent to the first bottom section side wall and generally facing the second bottom section side wall and a second angled surface adjacent to the second bottom section side wall and generally facing the first bottom section side wall, each angled surface sloping downwardly and away from the adjacent bottom section side wall thereof, said angled surfaces for engaging the bottom corner edges of the humidifier pad and retaining the humidifier pad in spaced relationship to each of the bottom section side walls.

2. The humidifier pad frame of claim 1 wherein the first and second angled surfaces comprises the edges of plates within the bottom section, each plate mounted adjacent to an edge of the floor.

3. The humidifier pad frame of claim 2, including first and second pairs of first and second angled surfaces, the first pair of angled surfaces located relatively close to the first side section and the second pair of angled surfaces located relatively close to the second side section.

4. The humidifier pad frame of claim 3, including at least one pad support in the frame, said pad support having an upwardly facing surface having a predetermined spacing from the floor of the bottom section and positioned generally between the bottom section's walls.

5. The humidifier pad frame of claim 4, wherein each of the side sections has on the internal surface thereof a spacer rib extending longitudinally for at least a portion of the side wall's length and projecting toward the other side section.

6. The humidifier pad frame of claim 5, wherein the spacer ribs extends longitudinally substantially the entire length of their associated side sections.

7. A frame assembly including the humidifier pad frame of claim 4, wherein the frame assembly includes an elongate water distribution tray for mounting between the top ends of the side sections, said tray having a floor for receiving water from a water source and an underside facing the bottom section of the frame and having two side edges extending the length thereof between the side sections of the frame, and a pair of angled surfaces generally facing each other, each of said surfaces sloping downwardly and outwardly from adjacent to a bottom surface side edge, said angled surfaces for engaging the top corner edges of the humidifier pad and retaining the humidifier pad between said angled surfaces in aligned relationship to the underside of the tray.

8. The frame assembly of claim 7, wherein the tray includes a pair of plates mounted adjacent to the side edges of the tray floor and projecting downwardly from the floor underside, each of said plates carrying one of the angled surfaces.

9. A frame assembly including the humidifier pad frame of claim 1, wherein the frame assembly includes an elongate water distribution tray for mounting between the top ends of the side sections, said tray having a floor for receiving water from a water source and an underside facing the bottom section of the frame and having two side edges extending the length thereof between the side sections of the frame, and a pair of angled surfaces generally facing each other, each of said surfaces sloping downwardly and outwardly from adjacent to a bottom surface side edge, said angled surfaces for engaging the top corner edges of the humidifier pad and retaining the humidifier pad between said angled surfaces in aligned relationship to the underside of the tray.

10. The frame assembly of claim 9, wherein the tray includes a pair of plates mounted adjacent to the side edges of the tray floor and projecting downwardly from the floor, each of said plates carrying one of the angled surfaces.

* * * * *